US005373218A

United States Patent [19]

Konopka et al.

[11] Patent Number: 5,373,218

[45] Date of Patent: Dec. 13, 1994

[54] TOGGLE BRIGHTENING CIRCUIT FOR POWERING GAS DISCHARGE LAMPS AND METHOD FOR OPERATING GAS DISCHARGE LAMPS

[75] Inventors: John G. Konopka, Barrington; Peter W. Shackle, Arlington Heights; J. Ray Wood, Naperville, all of Ill.

[73] Assignee: Motorola Lighting, Inc., Buffalo Grove, Ill.

[21] Appl. No.: 57,276

[22] Filed: May 4, 1993

[51] Int. Cl.[5] ..... G05F 1/00

[52] U.S. Cl. ..... 315/291; 315/209 R; 315/307; 315/DIG. 4; 315/DIG. 7

[58] Field of Search ..... 315/209 R, 219, 291, 315/226, 307, DIG. 2, DIG. 5, DIG. 7, 224, 241 R, 290, DIG. 4

[56] References Cited

U.S. PATENT DOCUMENTS

| | | | |
|---|---|---|---|
| 5,191,263 | 3/1993 | Konopka | 315/209 R |
| 5,194,781 | 3/1993 | Konopka | 315/291 |
| 5,248,919 | 9/1993 | Hanna et al. | 325/291 |

*Primary Examiner*—Robert J. Pascal
*Assistant Examiner*—Haissa Philogene
*Attorney, Agent, or Firm*—J. Ray Wood

[57] ABSTRACT

A circuit (100) for powering fluorescent lamps (102, 104 & 106) includes a switch (50) having "open" and "closed" positions. When power is initially applied to the circuit, the lamps are powered at full power to enable them to "strike". After a short period, the power is reduced to the lamp. A control circuit (300) thereafter senses if the switch has been "toggled". If toggled, the power to the lamps is increased, and the lamps brighten. The circuit uses a conventional two-position switch and conventional wiring and avoids the need for additional switches and additional wiring.

15 Claims, 1 Drawing Sheet

TOGGLE BRIGHTENING CIRCUIT FOR POWERING GAS DISCHARGE LAMPS AND METHOD FOR OPERATING GAS DISCHARGE LAMPS

FIELD OF THE INVENTION

This invention relates to a circuit for powering gas discharge lamps and a method for operating gas discharge lamps.

BACKGROUND OF THE INVENTION

A control circuit is typically used with one or more lamps to control the illumination of lamps from a switch having an "ON" and an "OFF" position. In such an application the control circuit senses when the switch is in the "ON" position and in response produces a signal to enable the lamp or lamps to produce illumination. The control circuit senses when the switch is in the "OFF" position and in response thereto produces a signal to disable the lamp or lamps from illuminating.

Such a control circuit provides control of the lamps in one of two conditions: full illumination or no illumination, depending on whether the switch is instantaneously in the "ON" position or "OFF" position respectively.

In some applications it is desired to control the lamps or lamps in a third condition: for example, at a level of illumination intermediate between full illumination and no illumination. In such an application it has heretofore been necessary to use either an alternative switch having three positions (for example, an "OFF" position, an "intermediate-ON" position and a "full-ON" position) instead of the two-position switch described above, or to use a further two-position switch in addition to the two-position switch described above in order to provide an additional switch position for the intermediate illumination condition of the lamp or lamps. In either case, whether a substitute switch or an additional switch is used to provide the additional switch position for intermediate illumination, additional wiring is typically required to connect the additional switch position to the control circuit.

If it is desired to "retro-fit" lighting having abilities of both "full-ON" and "intermediate-ON" (often referred to as "dimmable" lighting) as well as "OFF" into an existing installation having just "ON" and "OFF" abilities as described above, this will thus require the installation of a different or an additional switch and also require the installation of additional wiring, which will significantly increase the cost of the retro-fitting exercise if the switch or switches are wall-mounted and the additional wiring needs to be hidden within the wall and/or ceiling, as is typically the case.

In U.S. Pat. No. 5,194,781, assigned to the assignee herein, such a control circuit is shown which allow dimming of the circuit from a "bright" condition to a "dim" condition. The circuit initially energizes the lamps at full power. When a user toggles the switch from ON to OFF and back to ON, the lamps dim. In order to save energy, the user must take an affirmative action.

Some users may not take such an affirmative action, thus wasting energy by not using the dimming capability of the circuit. Thus, energy is wasted if users simply walk into a room and flip the switch ON without regard as to whether the lamps in a "dim" condition would produce sufficient energy for the users needs.

DESCRIPTION OF THE PREFERRED EMBODIMENT

Figure 1:
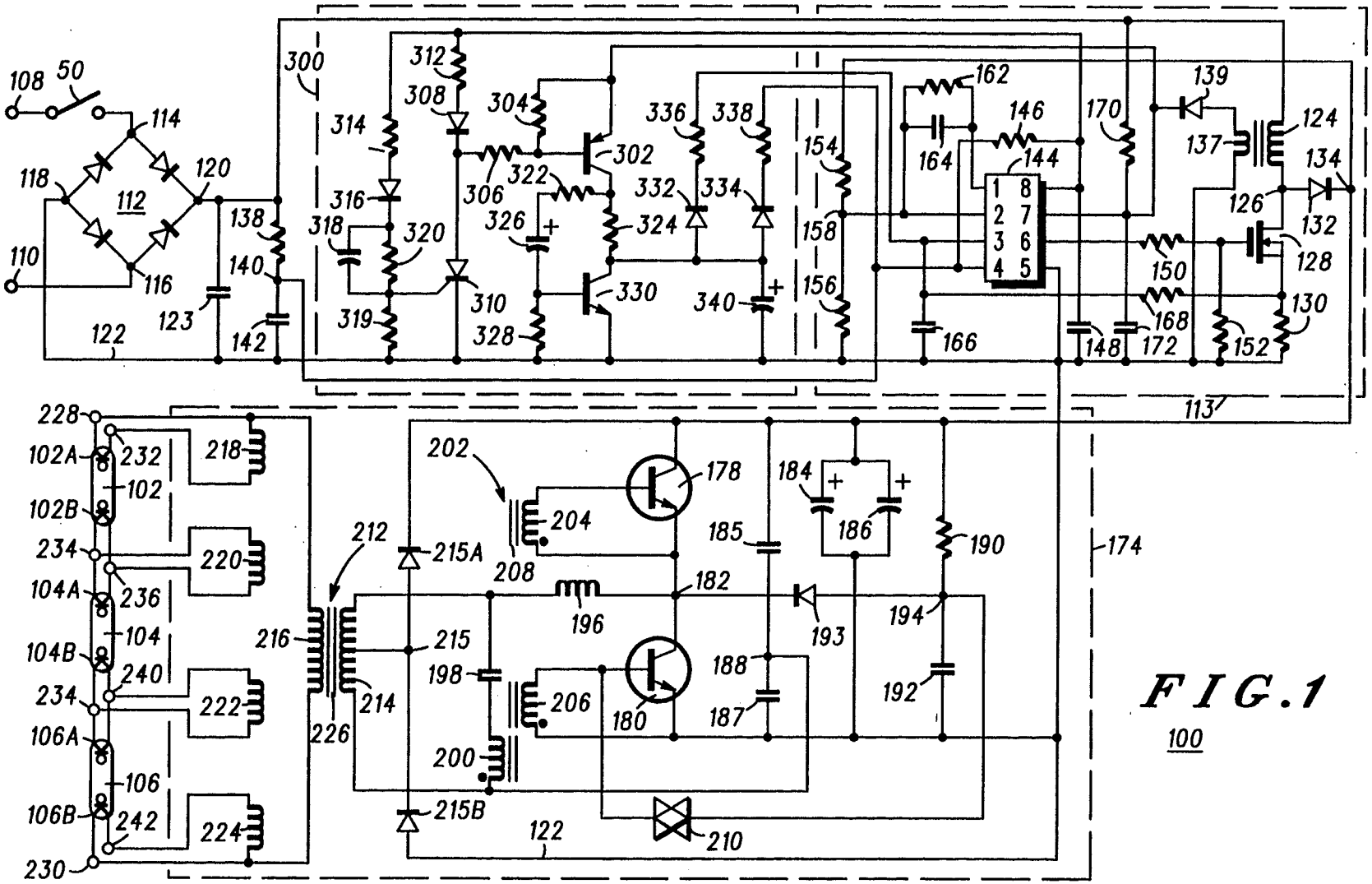
FIG. 1 shows a schematic circuit diagram of a driver circuit for driving three fluorescent lamps.

Referring now to FIG. 1, a circuit 100, for driving three fluorescent lamps 102, 104, 106, has two input terminals 108, 110 for receiving an AC power at a supply voltage of approximately 120 V at a frequency of 60 Hz.

To efficiently energize the lamps, the AC power at the first frequency of 60 Hz is converted to AC power at a second higher frequency. Circuit 100 includes a rectifier 112 for converting the AC power to DC power, a boost 113 for increasing the voltage of the DC power, and an inverter 174 for converting the DC power to AC power at a second frequency on the order of 40 KHz. The boost 113 and the inverter 174 are means for energizing the lamps.

A full-wave rectifying bridge circuit 112 has two input nodes 114, 116 and has two output nodes 118, 120. The input node 114 is connected to the input terminal 108 via a conventional two-pole, single throw switch 50 having an element (not shown) which is mechanically movable between "open" and "closed" positions. The input node 116 is connected directly to the input terminal 110. The output node 118 of the bridge 112 is connected to a ground voltage rail 122. A capacitor 123 (having a value of approximately 0.47 $\mu$F) is connected between the output nodes 118 and 120 of the bridge circuit 112.

A cored inductor 124 (having an inductance of approximately 1 mH) has one end connected to the output node 120 of the bridge 112, and has its other end connected to a node 126. A field effect transistor (FET) 128 (of the type IRF731) has its drain electrode connected to the node 126. The field effect transistor (FET) 128 has its source electrode connected, via a resistor 130 (having a value of approximately 0.51 $\Omega$), to the ground voltage rail 122. A diode 132 (of the type MUR160) has its anode connected to the node 126 and has its cathode connected to an output node 134.

A resistor 138 (having a resistance of approximately 1.2M$\Omega$) is connected between the output node 120 of the bridge 112 and a node 140. A capacitor 142 (having a capacitance of approximately 0.0039 $\mu$F) is connected between the node 140 and the ground voltage rail 122. A current-mode control integrated circuit (IC) 144 (of the type AS3845, available from ASTEC Semiconductor) has its $R_T/C_T$ input (pin 4) connected to the node 140. The current mode control IC 144 has its $V_{REG}$ output (pin 8) connected, via a resistor 146 (having a resistance of approximately 10K$\Omega$), to the node 140 and connected, via a capacitor 148 (having a capacitance of approximately 0.22 $\mu$F) to the ground voltage rail 122. The current mode control IC 144 has its control signal output (pin 6) connected, via a resistor 150 (having a resistance of approximately 20 $\Omega$), to the gate electrode of the FET 128. The gate electrode of the FET 128 is also connected, via a resistor 152 (having a resistance of approximately 22K$\Omega$), to the ground voltage rail 122.

Two resistors 154, 156 (having respective resistances of approximately 400K$\Omega$ and 4.02K$\Omega$) are connected in series, via an intermediate node 158, between the boost output terminal 134 and the ground voltage rail 122. The current mode control IC 144 has its $V_{FB}$ input (pin 2) connected to the node 158. The current mode control IC 144 has its COMP output (pin 1) connected to its $V_{FB}$ input (pin 2) via a parallel-connected resistor 162 (having a resistance of approximately 680KΩ) and capacitor 164 (having a capacitance of approximately 0.22 μF). The current mode control IC 144 has its current sense input (pin 3) connected to the ground voltage rail 122 via a capacitor 166 (having a capacitance of approximately 470 pF) and to the source electrode of the FET 128 via a resistor 168 (having a resistance of approximately 1KΩ).

The current mode control IC 144 has its $V_{CC}$ input (pin 7) connected to the bridge rectifier output node 120 via a resistor 170 (having a resistance of approximately 100KΩ) and connected to the ground voltage rail 122 via a capacitor 172 (having a capacitance of approximately 100 μF). The current mode control IC 144 has its GND input (pin 5) connected to the ground voltage rail 122. A winding 137, wound on the same core as the inductor 124, has one end connected to the ground voltage rail 122 and has its other end connected via a diode 139 to the $V_{CC}$ input (pin 7) of the IC 144.

The power supply output between boost output terminal 134 and ground rail 122 is connected to a half-bridge inverter 174 formed by two npn bipolar transistor 178 and 180 (each of the type BUL146). The transistor 178 has its collector electrode connected to the boost output terminal 134, and has its emitter electrode connected to an output node 182 of the inverter 174. The transistor 180 has its collector electrode connected to the node 182, and has its emitter electrode connected to ground rail 122. Two electrolytic capacitors 184 and 186 (each having a value of approximately 47 μF) are connected in parallel between boost output terminal 134 and ground rail 122.

Half bridge capacitors 185, 187, each having a value of 0.47 micro farads, are connected between boost output terminal 134 and ground rail 122, and are connected at node 188. The voltage at node 188 is ½ the voltage between boost output terminal 134 and ground rail 122.

For reasons which will be explained below, a resistor 190 (having a value of approximately 1MΩ) and a capacitor 192 (having a value of approximately 0.1 μF) are connected in series between boost output terminal 134 and ground rail 122 via an intermediate node 194. Diode 193 couples nodes 192, 194, where the cathode of diode 193 is connected to node 182.

The inverter output node 182 is connected to a series-resonant tank circuit formed by an inductor 196 (having a value of approximately 700 μH) and a capacitor 198 (having a value of approximately 15 nF). The inductor 196 and the capacitor 198 are connected in series, via a primary winding 200 of a base-coupling transformer 202, between the inverter output node 182 and the node 188. The base-coupling transformer 202 includes the primary winding 200 (having approximately 10 turns) and two secondary windings 204 and 206 (each having approximately 30 turns) wound on the same core 208. The secondary windings 204 and 206 are connected with opposite polarities between the base and emitter electrodes of the inverter transistors 178 and 180 respectively. The base electrode of the transistor 180 is connected via a diac 210 (having a voltage breakdown of approximately 32 V) to the node 194.

An output-coupling transformer 212 has its primary winding 214 connected in series with the inductor 196 and in parallel with the capacitor 198 and the primary, winding 200 of the base-coupling transformer 202 to conduct output current from the tank circuit formed by the series-resonant inductor 196 and capacitor 198. The primary winding 214 of the transformer 212 is tapped at node 215, which is coupled to the boost output terminal 134 and ground rail 122 via diodes 215A and 215B respectively.

The output-coupling transformer 212 includes the primary winding 214 (having approximately 91 turns), a principal secondary winding 216 (having approximately 280 turns) and four filament-heating secondary windings 218, 220, 222 and 224 (each having approximately 3 turns) wound on the same core 226. The principal secondary winding 216 is connected across output terminals 228 and 230, between which the three fluorescent lamps 102, 104 and 106 are connected in series. The lamps 102, 104 and 106 each have a pair of filaments 102A & 102B, 104A & 104B and 106A & 106B respectively located at opposite ends thereof. The filament-heating secondary winding 218 is connected across the output terminal 228 and an output terminal 232, between which the filament 102A of the lamp 102 is connected. The filament-heating secondary winding 220 is connected across output terminals 234 and 236, between which both the filament 102B of the lamp 102 and the filament 104A of the lamp 104 are connected in parallel. The filament-heating secondary winding 222 is connected across output terminals 238 and 240, between which both the filament 104B of the lamp 104 and the filament 106A of the lamp 106 are connected in parallel. The filament-heating secondary winding 224 is connected across the output terminal 230 and an output terminal 242, between which the filament 106B of the lamp 106 is connected.

The integrated circuit 144 and its associated components form a voltage-boost circuit 113 which produces, when activated, a boosted output DC output voltage of 250V between the boost output terminal 134 and ground rail 122. The detailed operation of such a voltage-boost circuit is described more fully in, for example, U.S. patent application Ser. No. 07/665,830, which is assigned to the same assignee as the present application, and the disclosure of which is hereby incorporated herein by reference.

The transistors 178 and 180, the inductor 196, the capacitor 198 and their associated components form a self-oscillating inverter circuit 174 which produces, when activated, a high-frequency (e.g. 40 KHz) AC voltage across the primary winding 214 of the output-coupling transformer 212. The voltages induced in the secondary windings 218, 220, 222 and 224 216 of the output-coupling transformer serve to heat the lamp filaments 102A & 102B, 104A & 104B and 106A & 106B and the voltage induced in the secondary winding 216 of the output-coupling transformer serves to drive current through the lamps 102, 104 and 106. The detailed operation of such a self-oscillating inverter circuit is described more fully in, for example, U.S. patent application Ser. No. 07/705,856, which is assigned to the same assignee as the present application, and the disclosure of which is hereby incorporated herein by reference.

In operation of the circuit of FIG. 1, with the switch 50 closed and with a voltage of 120 V, 60 Hz applied across the input terminals 108 and 110, the bridge 112 produces between the node 120 and the ground voltage rail 122 a unipolar, full-wave rectified, DC voltage having a frequency of 120 Hz.

When the circuit is first powered-up, the activation of the voltage-boost IC 144 is controlled, for reasons which will be explained below, by the resistive-capacitive divider 170, 172 connected between the output nodes 118 and 120 of the bridge circuit 112. The component values in the preferred embodiment of the circuit of FIG. 1 are chosen to produce a delay of approximately 0.7 seconds between initial power-up of the circuit and activation of the voltage-boost IC 144. Similarly, when the circuit is first powered-up, the activation of the self-oscillating inverter 174 is controlled by the resistive-capacitive divider 190, 192 connected between the boost output terminal 134 and ground rail 122. The component values in the preferred embodiment of the circuit of FIG. 1 are chosen to produce a delay of approximately 40 milliseconds between initial power-up of the circuit and activation of the self-oscillating inverter 174.

The circuit of FIG. 1 is so arranged that, with the self-oscillating inverter 174 activated but before activation of the voltage-boost IC 144, an unboosted voltage of approximately 160 V appears between boost output terminal 134 and ground rail 122, and the voltage induced in the secondary windings 218, 220, 222 and 224 is sufficient to produce significant heating of the filaments 102A & 102B, 104A & 104B and 106A & 106B, but the voltage induced in the secondary winding 216 is insufficient to cause the lamps to strike. However, after activation of the voltage-boost IC 144, a boosted voltage of approximately 250 VAC appears between the boost output terminal 134 and ground rail 122. The voltage induced in the secondary windings 218, 220, 222 and 224 continues to heat the filaments and the voltage induced in the secondary winding 216 is sufficient to cause the lamps to strike.

Thus, by arranging that (i) the unboosted voltage at the output terminals 134 causes heating of the filaments 102A & 102B, 104A & 104B and 106A & 106B but no striking of the lamps 102, 104 and 106, (ii) there is a delay of approximately $\frac{2}{3}$ seconds ($0.66=0.7-0.04$) seconds between activation of the self-oscillating inverter 174 and activation of the voltage-boost circuit 113; and (iii) the boosted voltage between the boost output terminal 134 and ground rail 122 causes striking of the lamps 102, 104 and 106 as well as continued heating of the filaments 102A & 102B, 104A & 104B and 106A & 106B, the circuit of FIG. 1 simply and effectively produces pre-heating of the lamp filaments before the lamps are caused to strike.

Such differentially delayed inverter/voltage-boost start-up is described in greater detail in U.S. patent application Ser. No. 07/705,865, which is assigned to the same assignee as the present application, and the disclosure of which is hereby incorporated herein by reference.

The ballast circuit 100 includes a control circuit 300. Control circuit 300 is coupled to a 15 V power output of IC 144 by transistor 302. To understand the operation of the circuit, the circuit must be considered during startup when switch 50 is turned on, and when switch 50 is toggled.

AT STARTUP:

When power is first applied to the circuit, transistor 302 is off. IC 144 turns on when the voltage at $V_{cc}$ (pin 7) increases to 10 volts. As voltage increases, transistor 302 will remain off, because current is stopped from flowing through resistor 304 and resistor 306 by diode 308 and thyristor 310, and thus the collector-base junction of transistor cannot become forward biased.

When $V_{REG}$ (pin 8) output of IC 144 becomes 5 V, current is blocked from flowing through resistor 312 and diode 308 by thyristor 310. Current does flow through resistor 314 and diode 316.

Since capacitor 318 is totally discharged at startup, it behaves initially like a short circuit. Thus, no current flows through resistor 320, which is connected in parallel with capacitor 318.

Current thus flows through resistor 319, creating a voltage on the gate of thyristor 310, triggering thyristor 310 on. When thyristor 310 turns on, current flows through resistors 304, 306, thereby forward biasing transistor 302. When transistor 302 turns on, a +15 V is produced at the junction of resistor 322 and resistor 324.

Current flows through resistor 322, into capacitor 326, and through resistor 328, thereby forward biasing transistor 330. As long as transistor 330 is on, current flowing through resistor 324 flows to GND of IC 144. No current flows through diodes 332, 334 and resistors 336, 338 into the IC 144 current sense control (pin 3) or the IC frequency control (pin 4).

As long as no current flows into either the IC current sense control (pin 3) or the IC frequency control (pin 4), full power appears at output terminals 134. Full power is required at output terminals 134 in order for lamps 102, 104, 106 to reliably strike.

Eventually, capacitor 326 will fully charge. When charged, no current flows through either capacitor 326 or resistor 328. With no current flowing through resistor 328, transistor 330 turns off. The length of time transistor 330 is on depends upon the time constant of the capacitance of capacitor 326 and resistor 322. If resistor 322 has a resistance of 100K ohms, then capacitor 326 should have a capacitance of 33 microfarads so that transistor 330 is on for about one second. One second of full power is sufficient for lamps 102, 104, 106 to reliably strike.

When transistor 330 turns off, current flows through capacitor 340. When capacitor 340 fully charges, diodes 332, 334 are forward biased. Current then flows through diode 332 and resistor 336 into the IC current sense control (pin 3) and through diode 344 and resistor 338 and into the IC frequency control (pin 4). When current flows into the IC 144, the IC 144 reduces the output power of the boost 113 by limiting the peak current of the boost 113. This, in turn, causes lamps 102, 104, 106 to dim.

The circuit, as thus far described, causes the lamps to be energized at full power for about one second to insure that the lamps strike, and then causes the lamps to be energized at less than full power thereafter. The lamps thus automatically dim after they strike.

In the illustrated embodiment, the low energy level of the lamps is about one-half that of the high energy level. One could modify the low energy level by adjusting the resistance of resistors 336, 338.

TOGGLING OF SWITCH:

The operation of the circuit will now be described when switch 50 is rapidly changed from a first state of "closed" to a second state of open (i.e., "toggled"). Toggling occurs when switch 50 is open for less than 0.5 seconds.

About 50 ms after switch 50 is open, the 15 V at pin 7 of the IC 144 will fall to zero. Then, no voltage will be present at either $V_{cc}$ (pin 7) or $V_{REG}$ (pin 8). Current stops flowing through thyristor 310, and thyristor 310 immediately unlatches.

However, there is a charge on capacitor 318. The capacitance of capacitor 318 and the resistance of resistor 320 is chosen for a time constant of 1.6 seconds.

When power is reapplied to the circuit by the closing of switch 50 before 0.5 seconds has elapsed, insufficient voltage will appear across the resistor 319 to trigger thyristor 310 . Thus, thyristor 310 remains unlatched, and no current will flow through resistors 304, 306, and, thus, transistor 302 will not conduct. Thyristor 310 thus acts as a sensor to determine whether there is a charge on capacitor 318.

If transistor 302 does not conduct, no current will flow into the IC current sense (pin 3) or the IC frequency sense (pin 4). Thus, full power will be applied at terminals 134 causing the lamps to be at full brightness.

SUMMARY OF CIRCUIT OPERATION

At startup, the circuit turns the lamps on for full brightness for a period of about one second to insure striking of the lamps. The circuit then automatically dims the lamps to a lower energy level. If switch 50 is toggled, the lamps are energized to a maximum energy level. If switch 50 is opened for a period longer than about 1 second and then closed, the lamps will turn on at full brightness for about one second, and then return to dim.

This mode of operation allows the lamps to be initially energized at a lower level, which enhances energy conservation. That is, a person must take a positive action to increase the energy consumed by the ps.

In many instances, a person will enter a room, flip the lamps on, and then go about his or her activities in the room. Utilizing the circuit herein described, the lamps will be automatically in an energy saving mode. If the person determines a need for more energy, he will need to take an affirmative action to expend that additional energy.

Table 1 shows the value of components for control circuit 300. Obviously, one skilled in the art could make various changes and modifications to the components and to the circuit without departing from the spirit of the invention.

TABLE 1

| Values of components for control circuit | |
|---|---|
| Transistor 302 | 2N3906 |
| Resistor 304 | 4.7K ohms |
| Resistor 306 | 22K ohms |
| Diodes 308, 316, 332, 334 | 1N4148 |
| Thyristor 310 | 2N5060 |
| Resistor 312 | 1K ohms |
| Resistor 314 | 3.3K ohms |
| Capacitor 318 | 1 microfarad, 10 Volts |
| Resistor 319 | 680 ohms |
| Resistor 320 | 1.6M ohms |
| Resistor 322 | 100K ohms |
| Resistor 324 | 5.11K ohms |
| Capacitor 326 | 33 microfarads, 16 Volts |
| Resistor 328 | 10K ohms |
| Transistor 330 | 2N3904 |
| Resistor 336 | 9.09K ohms |
| Resistor 338 | 9.53K ohms |
| Capacitor 340 | 10 microfarads, 10 Volts |

We claim:

1. A circuit for powering a gas discharge lamp from a source of AC power, comprising:

lamp energizing means for energizing the lamps at a high energy level and a low energy level;

a capacitor arranged to become charged when power is provided to the circuit;

a control circuit for controlling the lamp energizing means so that when power is applied to the circuit: if the level of charge of the capacitor is below a predetermined level, the lamp energizing means energizes the lamps at the high energy level for a short period of time until after the lamps are ignited, and then energizes the lamps at the low energy level after the short period of time; but if the level of charge of the capacitor is above a predetermined level, the lamp energizing means energizes the lamps at the high energy level.

2. The circuit of claim 1 including a switch having a first and second state coupled to the lamp energizing means and to the source of AC power, such that when the switch is in its first state, no power is supplied to the lamp energizing means, and when the switch is in its second state, full power is applied to the lamp energizing means.

3. The circuit of claim 2 where the lamp energizing means comprises an inverter.

4. The circuit of claim 3 wherein the low level of energy is about one-half the high level of energy.

5. The circuit of claim 4 where the control circuit includes a sensor for detecting whether the level of charge of the capacitance is more than a predetermined level.

6. The circuit of claim 5 where the sensor includes a thyristor arranged so that its state of conduction is dependent on whether the level of charge of the capacitor is more than a predetermined level.

7. The circuit of claim 6 where the short period of time is about one second.

8. A method of operating fluorescent lamps at either a low energy level or a high energy level comprising the steps of:

energizing the fluorescent lamps from a source of AC power so that the lamps strike;

automatically decreasing the energy supplied to the fluorescent lamps after a short period of time so that the lamps operate at the low energy level;

increasing the energy supplied to the fluorescent lamps so that the lamps operate at the high energy level if power to the fluorescent lamps is interrupted for a brief period of time.

9. The method of claim 8 where the brief period of time is less than one-half second.

10. The method of claim 9 including the steps of:

charging a capacitor when the lamps are energized;

discharging the capacitor when the lamps are not energized;

if the energy supplied to the lamps is interrupted, sensing if the capacitor is discharged;

if the capacitor has not discharged during the interruption of energy, operating the lamps at a high energy level.

11. A circuit for powering fluorescent lamps from a source of AC power at a first frequency comprising:

a rectifier controllably coupled to the source of AC power for converting the AC power to DC power;

a boost circuit coupled to the rectifier for increasing the voltage of the DC power to a high level or a low level;

an inverter coupled to the rectifier for converting the DC power to AC power at a second higher frequency;

a connector circuit for connecting the AC power produced lay the inverter to the fluorescent lamps;

a control circuit for causing the boost circuit to:

(1) produce DC power at the high voltage level in order to strike the lamps when power is first applied to the rectifier;

(2) produce DC power at the low voltage level after a short period of time after power is first applied to the rectifier; and (3) produce DC power at the high voltage level if power to the rectifier is momentarily interrupted.

12. The circuit of claim 11 including a switch for controlling whether AC power at a first frequency is coupled to the rectifier.

13. The circuit of claim 12 including a first capacitor coupled to the control circuit such that the first capacitor charges when the switch is closed, and discharges when the switch opens.

14. The circuit of claim 13 wherein the control includes a sensor for determining whether the level of charge on the first capacitor is greater than a predetermined level, and if the charge is greater than that predetermined level, increasing the voltage level of the boost.

15. The circuit of claim 14 including a second capacitor coupled to the control circuit such that, when power is first applied to the circuit, as the second capacitor charges, the control circuit causes the boost to produce power at a high voltage level, but, when the second capacitor is charged, causes the boost produce power at the low voltage level.

* * * * *

UNITED STATES PATENT AND TRADEMARK OFFICE

CERTIFICATE OF CORRECTION

PATENT NO. : 5,373,218

DATED : December 13, 1994

INVENTOR(S) : John G. Konopka, W. Shackle and J. Ray Wood

It is certified that error appears in the above-identified patent and that said Letters Patent is hereby corrected as shown below:

At Column 9, line 6 "lay" should read -by-

Signed and Sealed this

Fourth Day of April, 1995

*Attest:*

Bruce Lehman

BRUCE LEHMAN

*Attesting Officer*

*Commissioner of Patents and Trademarks*